United States Patent [19]

Rogers

[11] B 3,981,458

[45] Sept. 21, 1976

[54] SINGLE PIN GUIDE TRAVERSE

[75] Inventor: Lawrence W. Rogers, Brewton, Ala.

[73] Assignee: Monsanto Company, St. Louis, Mo.

[22] Filed: Nov. 7, 1974

[21] Appl. No.: 521,600

[44] Published under the second Trial Voluntary Protest Program on January 27, 1976 as document No. B 521,600.

Related U.S. Application Data

[63] Continuation-in-part of Ser. No. 236,535, March 8, 1972, abandoned.

[52] U.S. Cl. ..... 242/43 R; 242/158 B

[51] Int. Cl.[2] ..... B65H 54/30

[58] Field of Search ..... 242/43, 158 B

[56] References Cited

UNITED STATES PATENTS

| | | | |
|---|---|---|---|
| 2,340,436 | 2/1944 | Stone et al. | 242/158 B |
| 3,633,836 | 1/1972 | Haag | 242/43 |

*Primary Examiner*—Stanley N. Gilreath

*Attorney, Agent, or Firm*—Kelly O. Corley

[57] ABSTRACT

Two endless timing belts are positioned alongside the plane in which yarn is to be traversed, and move in planes parallel to the traverse plane. Each belt carries a yarn-engaging guide finger which projects through the traverse plane. The belts are synchronously driven, and are offset so that the yarn assumes a zigzag path in passing the fingers.

6 Claims, 2 Drawing Figures

SINGLE PIN GUIDE TRAVERSE

CROSS-REFERENCE TO RELATED APPLICATION

This application is a continuation-in-part of our copending application Ser. No. 236,535 which was filed on Mar. 8, 1972, now abandoned.

The invention relates to apparatus for traversing yarn in a plane in order to distribute the yarn along the surface of a package. More particularly, the invention relates to such apparatus wherein two synchronized yarn-guiding fingers move in separate parallel closed paths in the traverse plane, the paths being offset sufficiently that the yarn follows a zigzag path in passing the pins.

Many mechanisms have been suggested in the prior art for distributing yarn along the surface of a bobbin. A number of these are quite satisfactory at relatively low speeds, and typically involve a cam-driven yarn guide reciprocating in the traverse plane. Such mechanisms, however, become less reliable at higher speeds, and incur excessive maintenance costs at very high speeds.

Another general class of prior art traversing devices relies on transferring the yarn from a guide moving in one direction to a guide moving in the opposite direction. Aside from the difficulties in reliably performing the transfer, the yarn is frequently not under full control during the transfer period, and undesirable abrupt changes in yarn tension may be generated.

According to the present invention, these and other disadvantages of the prior art are avoided with a simple and reliable mechanism.

A primary object of the invention is to provide a traversing mechanism capable of reliable operation at very high speeds.

A further object is to provide a mechanism of the above character which is simple and inexpensive.

A further object is to provide a mechanism of the above character wherein the yarn is under control at all times.

Figure 1:
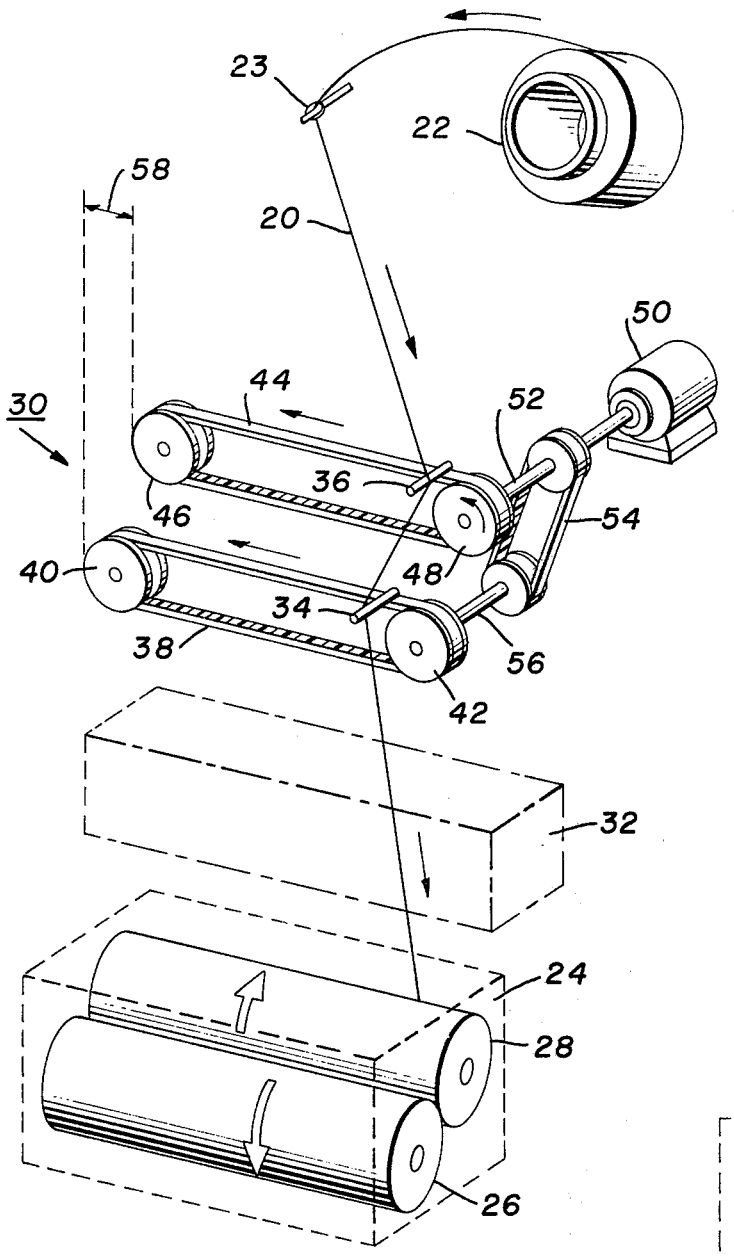
Figure 2:
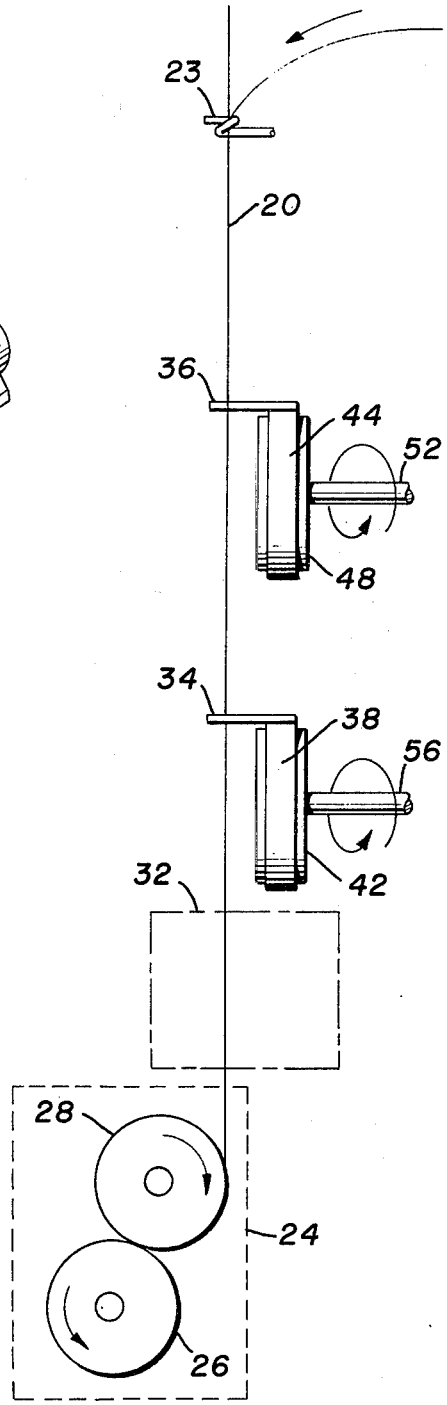

Other objects will in part appear hereinafter, and will in part be obvious from the following detailed description taken in connection with the accompanying drawing, wherein:

FIG. 1 is a schematic perspective view of the preferred embodiment of the invention, and FIG. 2 is a side elevation view.

As shown in the FIGURES, yarn 20 is fed from a yarn source illustrated as bobbin 22 including pigtail guide 23 to yarn winding means 24. As illustrated, winding means 24 includes bobbin 26 on which the yarn is wound, bobbin 26 being driven by surface contact with drive roll 28, although it could be of other conventional forms. As best illustrated in FIG. 2, yarn 20 may contact drive roll 28 before being wound on bobbin 26, but this feature is not necessary to the invention.

According to the invention, novel yarn traversing means 30 are provided for traversing the yarn laterally in a plane generally parallel to the axis of bobbin 26, in order to distribute the yarn along the surface of the bobbin. If desired, one may further provide an auxiliary traverse mechanism 32 between the primary traverse means 30 and the winding means 24, to more precisely control the yarn motion near the ends of bobbin 26. A preferred form of auxiliary traverse device is disclosed in U.S. Pat. No. 3,831,872. If an auxiliary traverse mechanism 32 is not provided, traverse means 30 should be located as near as possible to winding means 24.

Traverse means 30 includes yarn-engaging fingers 34 and 36 for engaging and traversing yarn 20 in a traverse plane parallel to the axis of bobbin 26. Finger 34, which is preferably formed from a material having a low coefficient of friction such as ceramic, is mounted on and supported by timing belt 38 for movement in a first closed path in the traverse plane. Belt 38 is mounted on toothed pulleys 40 and 42. Accordingly, the path of finger 34 in the traverse plane includes first and second generally parallel straight path segments defined when finger 34 moves laterally in the regions between pulleys 40 and 42. These straight path segments are connected to form a closed path in the traverse plane by the arcuate end path segments defined when finger 34 moves about the peripheries of pulleys 40 and 42. The only contact between yarn 20 and an element supported by belt 38 is contact between yarn 20 and finger 34. Finger 36 is similarly mounted on and supported by timing belt 44, which in turn is mounted on toothed pulleys 46 and 48, and moves in a similar closed path in the traverse plane. Motor 50 drives pulley 48 by means of shaft 52, and by means of timing belt 54 and shaft 56, drives pulley 42.

As illustrated, pulleys 40,42,46 and 48 are preferably all the same size, and preferably are as small as is commensurate with reasonable service life for belts 38 and 44.

According to a major aspect of the invention, pulleys 46 and 48 are offset somewhat with respect to pulleys 40 and 42, being displaced to the right as viewed in FIG. 1, in a plane parallel to the traverse plane, as indicated at 58. As illustrated, the left side of yarn 20 contacts the right side of finger 36 and the right side of yarn 20 contacts the left side of finger 34, yarn 20 thus assuming a zigzag path while passing the fingers. Preferably the displacement 58 is just enough to insure that the right side of yarn 20 contacts the left side of finger 34 at all times.

If one does not employ an auxiliary traverse mechanism 32, the mechanism illustrated would produce an asymmetrical package. In such a case, pulleys 42 and 48 should be somewhat smaller than pulleys 40 and 46 if the belts are driven in the direction shown.

Fingers 34 and 36 can be exactly synchronized, that is they reach their respective leftmost positions at the same point in time, and they reach their respective rightmost positions at the same point in time. Fingers 34 and 36 are driven at the same speed and in the same direction, that is, they alternately move from left to right during first time periods and from right to left during the intervening time periods.

In the preferred embodiment of the invention, however, finger 36 is driven to be slightly in advance of exact synchronism with finger 34, that is, finger 36 reaches points in its path just before finger 34 reaches corresponding points. In a particular construction, best results were obtained when finger 36 was spaced 0.150 inch in advance of exact synchronism with finger 34. In this exemplary construction, all pulleys had a diameter of about 0.750 inch, and offset distance 58 was 0.5 inch. The optimum amount by which finger 36 should be ahead of exact synchronism with finger 34 will vary somewhat depending on such factors as the offset distance, pulley diameter, the helix angle at which the yarn is wound, the location of the yarn source with respect to the traverse mechanism, and other such factors, and can readily be determined by those skilled in the art.

Upper finger 36 and its associated support means has been shown as displaced to the right of finger 34, for convenience of illustration. Similar results would be achieved if it were displaced to the left, forming a mirror image of the illustrated construction. In this latter case, the right side of yarn 20 would contact the left side of finger 36 and the left side of yarn 20 would contact the right side of finger 34.

The principal function of finger 36 is to act as a guide for maintaining the selected side (either the right or left side) of yarn 20 in substantially continuous contact with the external surface of finger 34. Finger 36 and belt 44 accordingly could be replaced with other means for performing this function, such as by a cam or by any other yarn-traversing mechanism.

The disclosed apparatus has been successfully operated at very high speeds, such as 1000 traverse cycles per minute, and is capable of reliable operation at much greater speeds.

The yarn is maintained in continuous contact with the external surface of the finger at one side of a plane coinciding with the axis of the finger.

The term "finger" is used herein in the ordinary sense of a single element protruding through the traverse plane for continuously contacting the yarn, the only contact between yarn 20 and an element supported by belt 38 being contact between yarn 20 and finger 34, and is used as distinguished from those constructions such as are shown in U.S. Pat. No. 3,633,836 wherein the yarn runs between two elements protruding through the traverse plane and which elements alternately contact and drive the yarn.

I claim:

1. In apparatus wherein yarn is fed from a yarn source to a yarn winding means rotating about an axis, yarn traversing means for traversing said yarn in a plane generally parallel to said axis, said traversing means comprising:

a. a yarn-engaging finger extending through said plane;

b. support means supporting said finger for movement in a closed path in said plane and between said yarn source and said yarn winding means, said path including first and second generally parallel straight segments connected by first and second arcuate end segments, said first and said second segments being generally parallel to said axis, the only contact between said yarn and an element supported by said support means being contact between said yarn and said finger;

c. and guide means for maintaining said yarn in continuous contact with the external surface of said at one side of a plane coinciding with the axis of said finger.

2. In apparatus wherein yarn is fed from a yarn source to a yarn winding means rotating about an axis, yarn traversing means for traversing said yarn in a first plane generally parallel to said axis, said traversing means comprising:

a. a first yarn-engaging finger extending through said first plane;

b. first support means supporting said first finger for movement in a first closed path in said first plane and between said yarn source and said yarn winding means, said first path including first and second generally parallel straight segments connected by first and second arcuate end segments, said first and said second straight segments being generally parallel to said axis;

c. a second yarn-engaging finger;

d. second support means supporting said second finger for movement in a second closed path in said first plane and between said yarn source and said first finger, said second path including third and fourth generally parallel straight segments connected by third and fourth arcuate end segments, said third and fourth straight segments being generally parallel to said axis; and e. means driving said first and said second fingers at the same speed and in the same direction in said paths;

f. said first and said second closed paths being offset with respect to one another whereby yarn traveling from said source to said winding means travels in a zigzag path in passing said first and said second fingers.

3. The apparatus defined in claim 2, wherein said first and said second support means comprise respective first and second endless timing belts.

4. The apparatus defined in claim 2, wherein said source is spaced substantially equidistant from said third and said fourth end segments.

5. The apparatus defined in claim 2, wherein said second finger is driven in advance of exact synchronism with said first finger.

6. The apparatus defined in claim 2, wherein at least one of said first and said second support means comprises pulleys of unequal diameter.

* * * * *

UNITED STATES PATENT AND TRADEMARK OFFICE

CERTIFICATE OF CORRECTION

PATENT NO. : 3,981,458

DATED : September 21, 1976

INVENTOR(S) : Lawrence W. Rogers

It is certified that error appears in the above-identified patent and that said Letters Patent are hereby corrected as shown below:

In Column 4, line 4, after "said" insert "finger"

Signed and Sealed this

Sixteenth Day of November 1976

[SEAL]

*Attest:*

RUTH C. MASON
*Attesting Officer*

C. MARSHALL DANN
*Commissioner of Patents and Trademarks*